US007707950B2

(12) United States Patent
Villiger

(10) Patent No.: US 7,707,950 B2
(45) Date of Patent: May 4, 2010

(54) MULTIFUNCTIONAL, PORTABLE SECURITY SYSTEM

(76) Inventor: Peter Villiger, Mitteldorf 10, 5637 Beinwil (CH)

( * ) Notice: Subject to any disclaimer, the term of this patent is extended or adjusted under 35 U.S.C. 154(b) by 150 days.

(21) Appl. No.: 11/664,485

(22) PCT Filed: Sep. 21, 2005

(86) PCT No.: PCT/EP2005/054733

§ 371 (c)(1),
(2), (4) Date: Apr. 3, 2008

(87) PCT Pub. No.: WO2006/037729

PCT Pub. Date: Apr. 13, 2006

(65) Prior Publication Data

US 2008/0264309 A1 Oct. 30, 2008

(30) Foreign Application Priority Data

Oct. 1, 2004 (CH) ..... 1608/04

(51) Int. Cl.
*E05G 1/00* (2006.01)

(52) U.S. Cl. ..... 109/24; 109/25; 109/29; 109/32; 340/5.61; 340/5.64; 340/5.73; 340/568.7

(58) Field of Classification Search ..... 109/24, 109/25, 29–34; 340/5.73, 568.7, 5.61–5.64, 340/539.31
See application file for complete search history.

(56) References Cited

U.S. PATENT DOCUMENTS 2,384,826 A * 9/1945 Ferguson ..... 109/25
4,391,203 A * 7/1983 Millar ..... 109/25
4,799,435 A * 1/1989 Boutroy ..... 109/25
4,852,502 A * 8/1989 Klingberg et al. ..... 109/25
5,615,625 A * 4/1997 Cassidy et al. ..... 109/45
6,065,408 A * 5/2000 Tillim et al. ..... 109/25
7,121,215 B2 * 10/2006 Besnard ..... 109/25
7,428,873 B1 * 9/2008 Searle et al. ..... 109/24
2003/0011466 A1 * 1/2003 Samuel et al. ..... 340/5.73

FOREIGN PATENT DOCUMENTS

DE 101 27 691 A1 1/2003
WO WO 99/35622 A 7/1999
WO WO 01/69026 A 9/2001

OTHER PUBLICATIONS

International Search Report for PCT/EP2005/054733.

* cited by examiner

*Primary Examiner*—Lloyd A Gall
(74) *Attorney, Agent, or Firm*—McCarter & English, LLP

(57) ABSTRACT

Security system having a container, which encloses a strongbox area for receiving valuables. A device for carrying the container, a protection system for protecting the valuables located in the strongbox area, and an access opening are provided. At least one protection module is provided in the strongbox area, the protection module being designed for the purpose of neutralizing the valuables located in the strongbox area. The device for carrying is implemented as a separate module, which comprises a handle area, a mechanical interface for the mechanical connection to the container, a security circuit for securing the security system, and a security interface for establishing a communication link between the security circuit and the protection module.

17 Claims, 6 Drawing Sheets

MULTIFUNCTIONAL, PORTABLE SECURITY SYSTEM

BACKGROUND OF THE INVENTION

1. Field of the Invention

The present invention relates to a portable security system having a container which encloses a strongbox area for receiving valuables, means for carrying the container, a protection system for protecting the valuables located in the strongbox area, and an access opening, to be able to open the container and make the strongbox area accessible.

2. Description of Related Art

There are greatly varying security cases for transporting objects in need of protection, such as valuables like coins and banknotes, securities, other valuable objects such as precious metals and precious stones, documents to be kept secret, or possibly also toxic materials, rare materials, or material to be shielded in another way, such as radioactive material.

The security cases typically have a strongbox area, a protection system, and an access opening, which may be closed and makes the security case accessible in the open state.

The protection system is used for the purpose of protecting the owner or possessor of the valuables from a misuse of the valuables, if they are lost in the event of a theft. This is performed by automatically neutralizing and/or devaluing the valuables in such a case. The corresponding known protection systems are costly and complex.

As already noted, there are different types of valuables to transport. The cases must have different sizes depending on the type of the valuables. In addition, greatly varying security guidelines may apply. In practice, there is therefore a large number of greatly varying cases in use.

It is important for cases of this type that they correspond to the corresponding security guidelines, are portable, and above all are flexibly usable. Current cases only partially fulfill these criteria. In addition, the cases are currently relatively expensive.

BRIEF SUMMARY OF THE INVENTION

It is the object of the present invention,

- to provide a security system of the type cited at the beginning, which ensures high security and is simple to handle,
- to suggest a multifunctional security system of type cited at the beginning, which allows high flexibility in its operability, and
- to provide a security system of the type cited at the beginning, which is cost-effective.

This object is achieved for a security system by the features set forth herein.

Preferred refinements of the security system are defined by the dependent claims.

The protection system comprises at least one protection module, which is housed either in the strongbox area of the container or in a cassette to be transported, such as a currency cassette. In an emergency, i.e., if the security system is wrongfully handled or actuated, the valuables located therein are neutralized (devalued), i.e., they are damaged or destroyed.

The valuables are preferably packed in currency cassettes (ATM cassettes) and these currency cassettes are then laid or inserted into the strongbox area. These currency cassettes have a communication interface to connect them with a circuit of a separate (portable) module. In case of emergency, a protection module located in the currency cassette is triggered to neutralize the valuables using ink or a similar material.

A handle or a recessed grip is situated on the separate (portable) module, at which the entire security system may be carried manually, possibly with the aid of an auxiliary device. The recessed grip may be implemented in such a way that it has a light barrier or a mechanical interrupter. As soon as a currency carrier or another authorized person lets go of the security system, the neutralization procedure is triggered. This procedure may be implemented in multiple stages and is externally settable in a preferred embodiment (by a Pocket PC or a computer via an interface).

A part of the protection system, namely the security circuit, is housed in the separate (portable) module. This part is the most expensive of the entire security system. Therefore, the module is designed according to the present invention in such a way that it may be placed on various containers. Such a container then becomes a component of the overall security system due to the connection to the module.

The security circuit is preferably an electrical/electronic circuit. This security circuit is a part of the protection system. It is an advantage of the present invention that this part of the protection system is located in a protected area of the (portable) module and therefore may not be externally accessed or influenced.

In an especially advantageous embodiment, an access opening is located in the upper wall (cover) of the container. The cover is secured by the docking of the (portable) module.

BRIEF DESCRIPTION OF THE SEVERAL VIEWS OF THE DRAWINGS

Further features and characteristics of the present invention are explained in greater detail in the following on the basis of exemplary embodiments and with reference to the drawing.

DETAILED DESCRIPTION OF THE INVENTION

Constructive elements which are identical and/or act identically in principle are provided with identical reference signs in the figures, even if they partially differ from one another.

Figure 1:
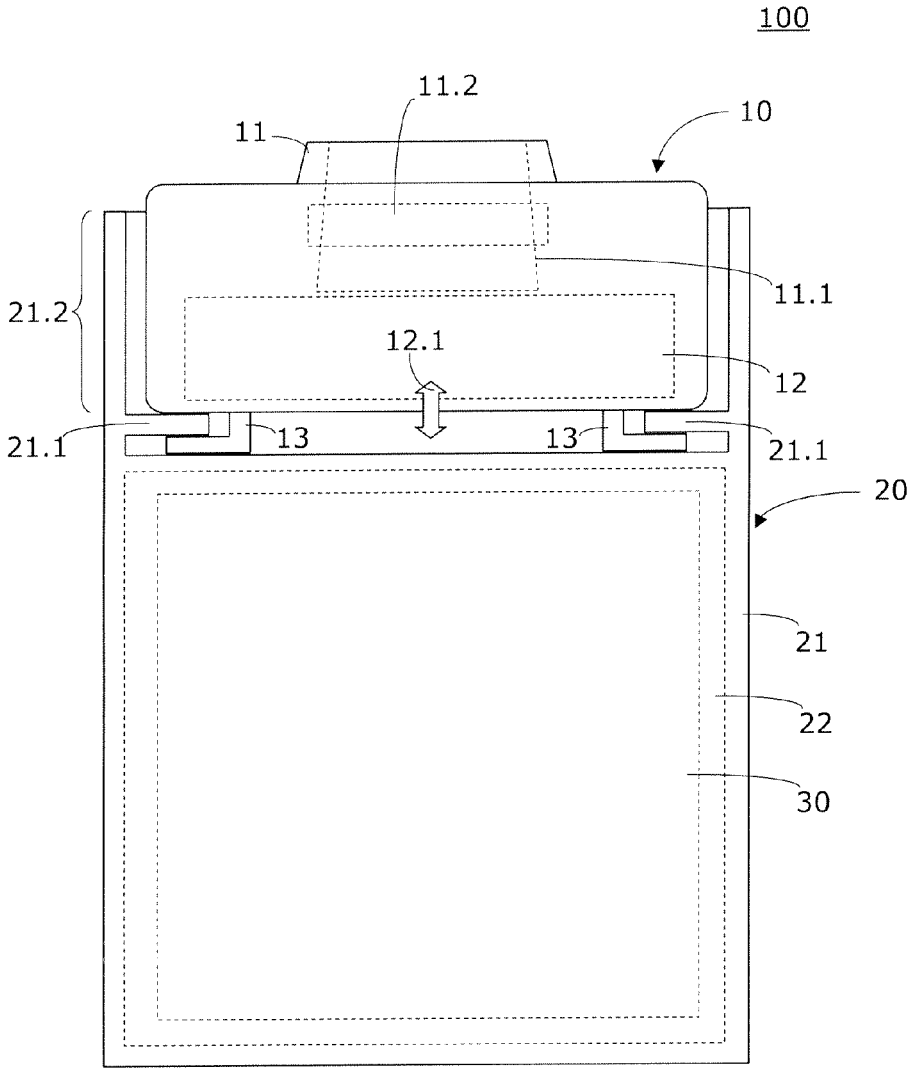
FIG. 1 shows a first security system according to the present invention, in a schematic side view.

FIG. 1 shows a schematic view of a first embodiment of the present invention. A security system 100 is shown, which is used for receiving the valuables, in particular during transport. To be able to explain the details of the present invention better, elements which are seated in the interior are indicated by dashed lines in FIG. 1.

The security system 100 comprises a container 20, which encloses a strongbox area 22 for receiving valuables. Means 10 are provided for carrying the container 20. Furthermore, a protection system 12 is provided for protecting the valuables located in the strongbox area 22. The container 20 has an access opening to open the container 20 and make the strongbox area 22 accessible. This access opening is preferably located in a cover of the container 20. According to the present invention, at least one protection module 23, 41 is provided in the strongbox area 22. This protection module 23, 41 is either seated in the strongbox area 22 itself (cf. FIG. 4) or a (currency) cassette 30 or 40 (cf. FIG. 3) is introduced or inserted into the strongbox area 22.

According to the present invention, the protection module 23, 41 is designed for the purpose of neutralizing the valuables located in the strongbox area 22. The means 10 for carrying are implemented according to the present invention as a separate (portable) module, which has a handle area 11.1 having a handle 11.2. Furthermore, a mechanical interface 13 is provided for the mechanical connection to the container 20. An embodiment is shown in FIG. 1, in which the (portable) module 10 has two angles 13 or rails on the bottom. Two counterparts 21.1, such as angles or rails, are provided on the container 20. In the example shown, the (portable) module 10 may be pushed onto the container 20 from the front and docked in this way. The container 20 is preferably equipped with a docking area 21.2 for this purpose.

As indicated in FIG. 1, the (portable) module 10 comprises a security circuit 12 for securing the entire security system 100. According to the present invention, a security interface 12.1 is provided to be able to establish a communication link between the security circuit 12 and the protection module 23, 41 in the strongbox area 22. This security interface 12.1 is indicated by a double arrow in the figures, because it is a security interface which permits two-way communication.

In the security system 100 shown in FIG. 1, a (currency) cassette 30 is stored and protected in the strongbox area 22.

Figure 2:
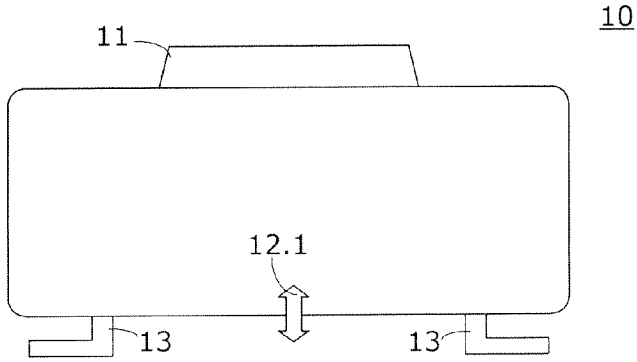
FIG. 2 shows a schematic side view of a (portable) module according to FIG. 1.

A side view of the (portable) module 10 without container 20 is shown in FIG. 2. The (portable) module 10 is preferably manufactured from Kydex®, to prevent manipulation or damage. The (portable) module 10 shown may be combined with greatly varying containers. Therefore, a container which corresponds to the current requirements may be selected as needed. Depending on the number of currency cassettes to be retrieved, for example, a small or a large container may be taken along by the currency carrier. The currency carrier may grasp and carry the container by simple docking.

After the (portable) module 10 has been removed, the container 20 is preferably switched into a special mode to ensure additional protection against manipulation. During the transport using the (portable) module 10, the security circuit 12 may assume control over certain functions.

Figure 3:
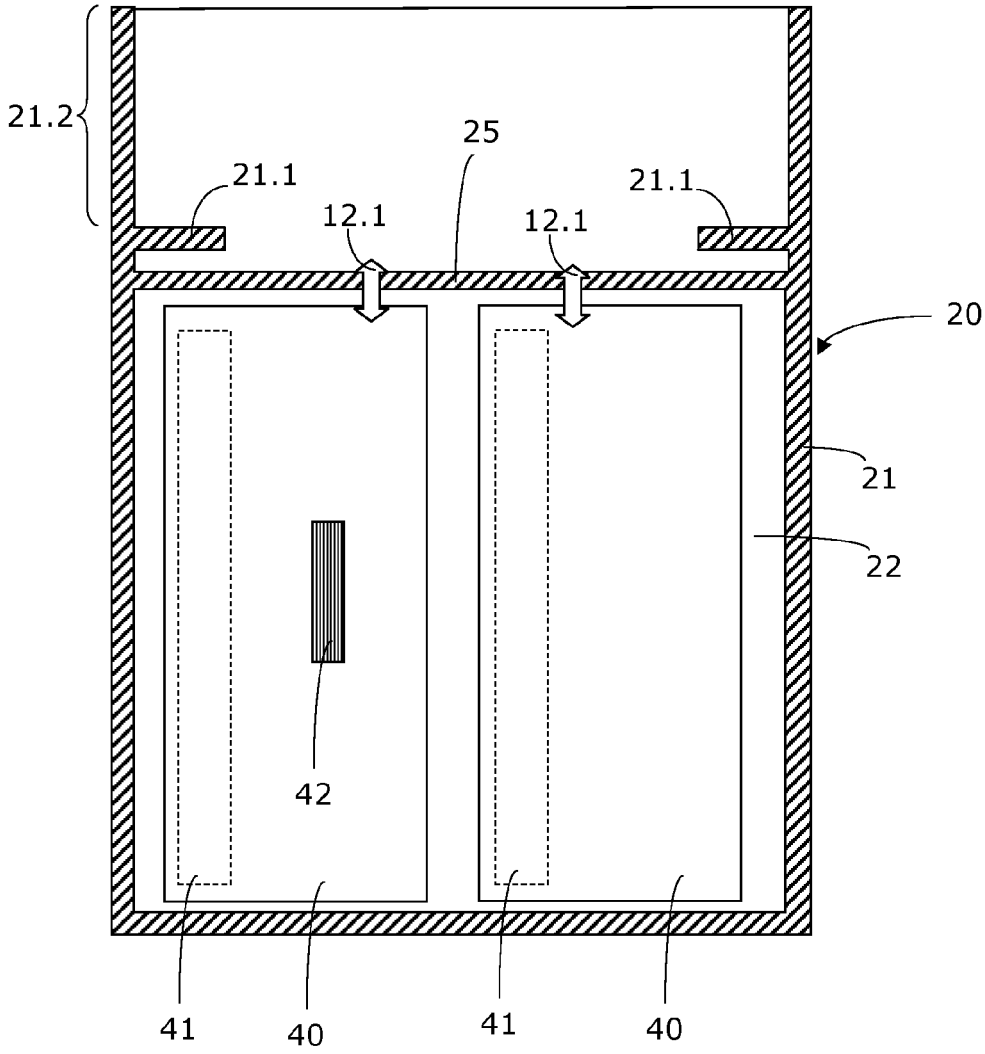
FIG. 3 shows a second security system according to the present invention, in a schematic sectional view.

A schematic section through another container 20 is shown in FIG. 3. The docking point 21.1 is recognizable in the upper area. Two rails 21.1 are provided on the lateral walls. However, there are also other possibilities for producing a mechanically detachable connection between such a (portable) module 10 and a container 20. In the example shown, two (currency) cassettes 40 are located in the strongbox area 22. The cassettes 40 both stand upright and are inserted from above when cover 25 is open. At least one protection module 41 is located in each of the cassettes 40. There is space for valuables 42, such as banknote bundles, next to the protection modules 41. There is a security interface 12.1 with each of the two cassettes 40.

Figure 4:
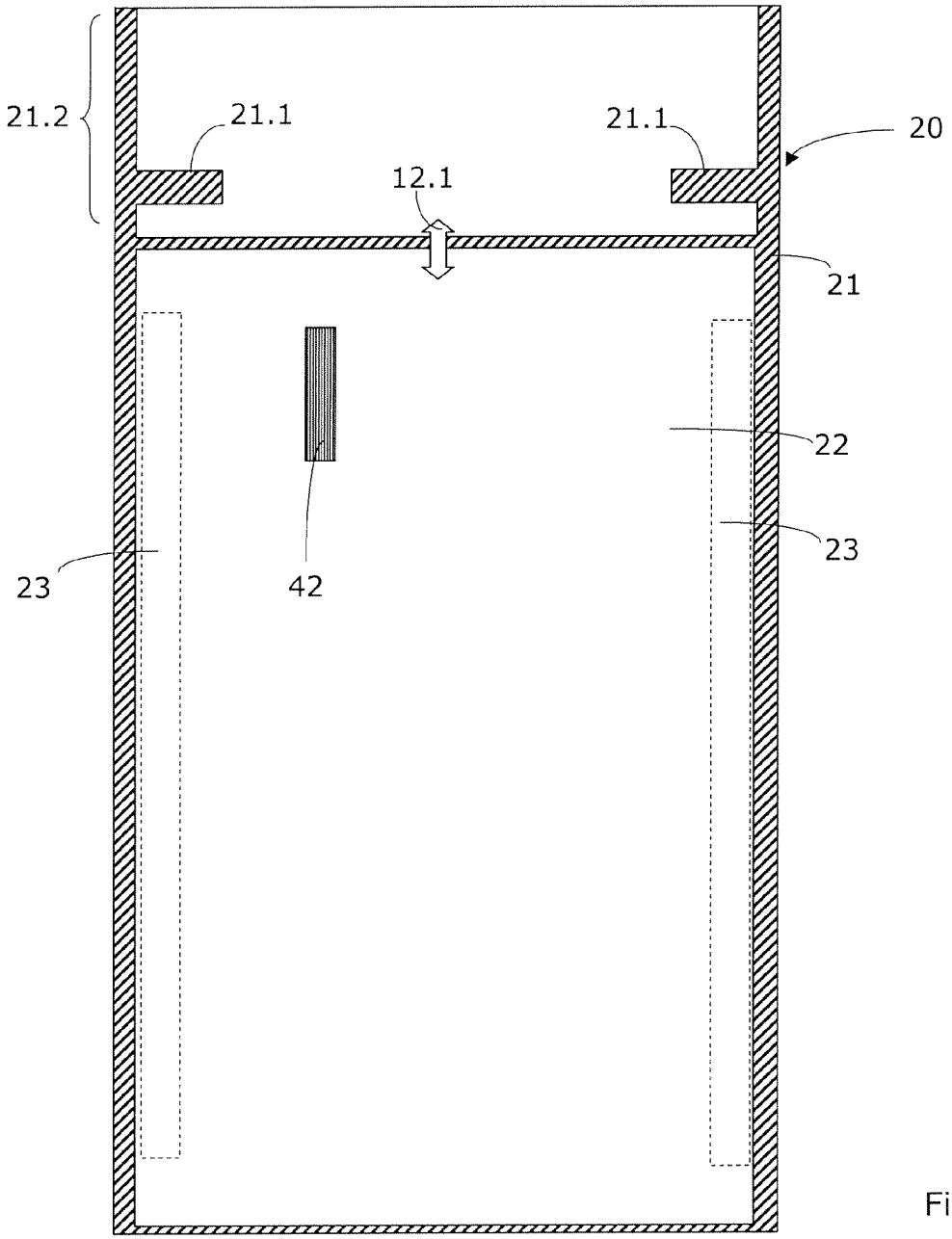
FIG. 4 shows a third security system according to the present invention, in a schematic sectional view.

FIG. 4 shows a further container 20, which is taller than that shown in FIG. 3. This container 20 is designed for the purpose of directly receiving valuables 42. In order to ensure this protection, protection modules 23 are situated on both sides. There is also a security interface 12.1 here to connect a docked (portable) module 10 to the protection modules 23, so that they may be triggered in case of emergency to neutralize the valuables.

According to the present invention, it is especially important that a mechanically stable connection is easily producible between the (portable) module 10 and a container 20. However, this mechanical connection must be easily detachable again, in order to be able to remove the (portable) module 10 and use it in another way. A stable mechanical connection is necessary in particular because the security interface 12.1 between the (portable) module 10 and the container 20 must function reliably and without malfunction.

Figure 5:
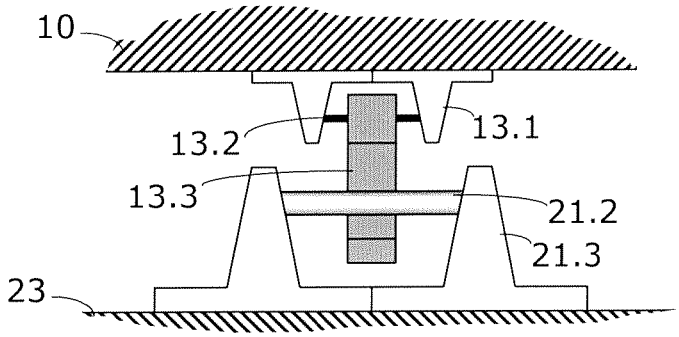
FIG. 5 shows a schematic detail of the mechanical connection between a (portable) module and a container, according to the present invention.

A detail of a security system is shown in FIG. 5 to be able to explain a possible embodiment of the mechanical connection. In the embodiment shown, a latch 13.3, which is mounted movably in a bearing 13.1 via an axis 13.2, is seated on the bottom of the (portable) module 10. This latch 13.3 may be pivoted out of the plane of the drawing or into the plane of the drawing. On the opposite side, an element 21.2 is located on the cover 25 of the container 20, in which the latch 13.3 may latch. The element 21.2 is supported by a bearing 21.3.

Instead of one latch 13.3, two separate latches may also be used. However, it is also possible according to the present invention to operate entirely without latches, as indicated in FIG. 1.

It is expressly noted that the methods and devices described for docking are solely to be viewed as examples, and greatly varying other methods, in particular mechanical, pneumatic, and electromechanical types, may be used for docking.

Figure 6:
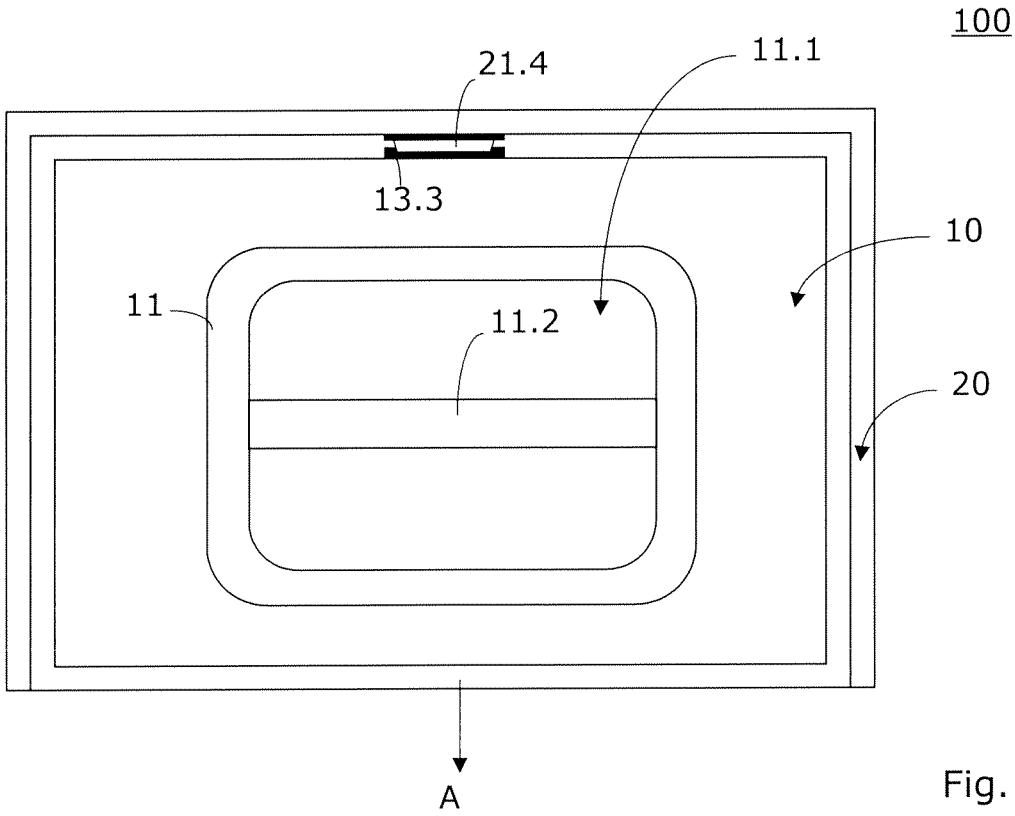
FIG. 6 shows a fourth security system according to the present invention, in a schematic top view.

An example of an electrical connection is shown in a top view in FIG. 6. In the illustration shown, a (portable) module 10 is seated in the docking area on the container 20. The recessed grip 11.1 having the handle 11.2 may be recognized in FIG. 6. As indicated by an arrow A, the (portable) module 10 may be pulled out of the docking area 12.1. A plug element 13.3 is located on the rear of the (portable) module 10, which produces an electrical connection to a plug element 21.4, which is located on a rear wall of the container 20, in the docked state.

Figure 7:
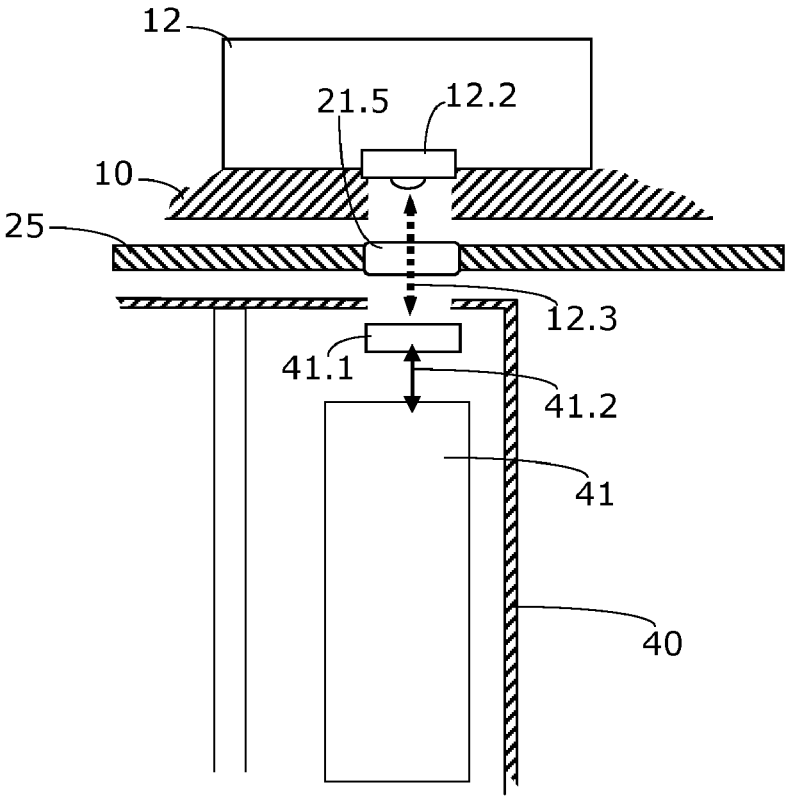
FIG. 7 shows a schematic detail of the mechanical connection between a further (portable) module and a container according to the present invention.

FIG. 7 shows a schematic section through a part of a security system. The construction of a possible embodiment of a contactless connection 12.1 is explained on the basis of this section. A security circuit 12 is seated inside the (portable) module 10. Only a lower wall of the (portable) module 10 is shown in FIG. 7. The security circuit 12 comprises a transmitter 12.2. This may be an infrared transmitter, for example. However, transmitters which operate in another wavelength range may also be used. An RF transmitter may also be used.

In the example shown, a (currency) cassette 40 is located inside the container 20. Only one corner may be recognized of this cassette 40. A protection module 41 is seated inside the cassette 40. A receiver 41.1 (such as an IR detector) is seated in the upper area of the cassette 40, which is connected to a circuit or to the protection module 41, for example, as indicated in FIG. 7 by the arrow 41.2.

An opening is provided in each case in the lower wall of the (portable) module 10, the cover 25 of the container 20, and the cassette 40. When the (portable) module 10 and the container 20 are mechanically connected to one another (e.g., using hooks 13/rails 21.1 and/or using a latch connection) and the cassette 40 is in a permanently predefined position, for example, all three openings lie one above the other. A continuous optical link may thus be established, as indicated by the double arrow 12.3. A transparent element or a lens 21.5 may be provided in the cover 25 of the container 20.

Using an inductive or capacitive coupling as a link is also conceivable.

The communication link is preferably a link which allows encrypted communication.

Figure 8:
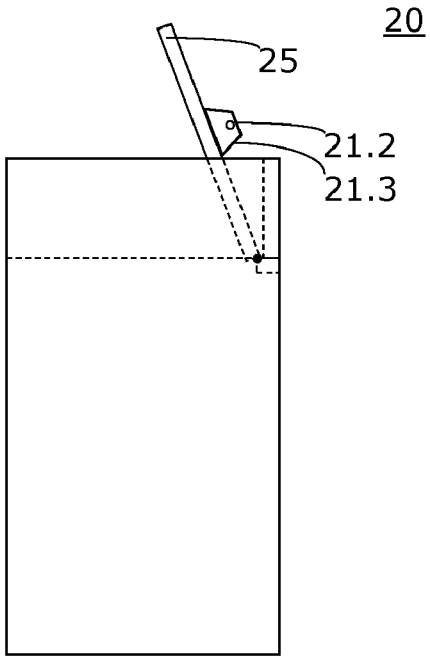
FIG. 8 shows a container according to the present invention, in a schematic side view.

A side view of an embodiment of the container 20 is shown in FIG. 8. The cover 25 of the container 20 is open and the strongbox area may be filled. In the embodiment shown, the cover 25 carries the two elements 21.2 and 21.3, which are shown in greater detail in FIG. 5. It is important that the cover 25 is protected against opening after the docking of the (portable) module 10.

The (portable) module 10 is generally used for the purpose of manually transporting the security system 100 without further aids. Measures may also be taken to manually lift and displace the security system 100 with the aid of an additional device, or to transport the security system 100 in an automated conveyance system.

It is also possible and may be used for increased security and/or standalone security if the container and the portable module are implemented in such a way that only one opening of the container coupled to the portable module is possible.

The recessed grip 11.1 or another area of the security system 100 may be implemented in such a way that it triggers the neutralization via a light barrier or a cable in the event it is snatched or put down. An interface may also be provided to be able to program the security system 100 externally using a PDA or a computer in combination with the recessed grip 11.1 or in another way.

The protection system having a security circuit and at least one protection module 41 is used for the purpose of protecting the valuables 42 located in the strongbox area 22 in case of emergency, i.e., for example in the event of handling or actuation of the security system 100 by an individual unauthorized for this purpose, or above a specific temperature. This protection comprises preventing misuse of the valuables 42 by neutralizing (devaluing) them in some suitable way. This neutralization may be performed, for example, in such a way that the valuables 42 may retain or reacquire their value for the authorized owner or possessor.

In the present exemplary embodiment, the protection modules 23, 41 are modules having free-flowing materials which, preferably under pressure, discharge powdered, pasty, or liquid materials, in particular inks, preferably from two sides, onto the valuables 42, by which the latter are devalued.

Figure 9:
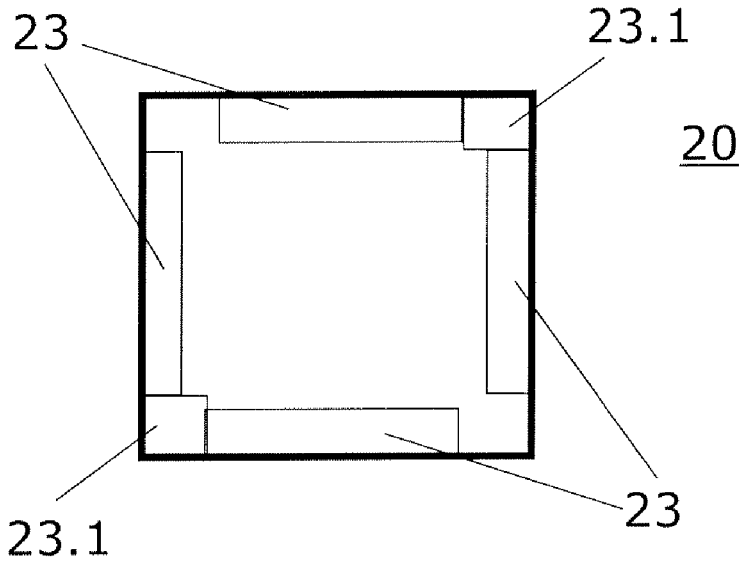
FIG. 9 shows a security container according to the present invention having additional security precautions, in a horizontal section.

As shown in FIG. 9, for example, four protection modules 23 may also be provided, which are situated in such a way that the free-flowing materials are discharged from multiple directions onto the valuables in the strongbox area, to ensure that each of the valuables is reached by free-flowing material. In any case, it is advantageous to situate more than one protection module 23.

A heater may be provided for additional security of the valuables, using which receptacles, in particular plastic receptacles, which contain the valuables may be melted, so that the valuables are actually reached by the free-flowing materials such as inks, even if they are supplied in such receptacles. The heater may be started by activated ignition fuses. As also shown in FIG. 9, these ignition fuses may be situated separately, as indicated schematically by 23.1, or may be inserted into a housing and/or a housing wall of the modules 23 containing the free-flowing material.

The protection system may be implemented in such a way that it is possible to access the strongbox area 22 with or without actuation of an additional auxiliary element such as a (contactless) key.

The valuables may additionally be protected by providing a mechanical or electronic seal. Such a seal is not primarily intended to obstruct opening of the container, but rather to be able to establish unauthorized, but unforced opening, for example, by the currency carrier himself.

Finally, the container 20 may also be implemented in such a way that it has a separate security electronic system, which may be implemented similarly to the security circuit of a (currency) cassette.

A thermoplastic material, preferably a Kydex® material, has been shown to be a suitable material for the container 20 and/or the (portable) module 10 or for parts thereof. However, greatly varying other materials are also suitable for producing the security system 100.

The security system 100 preferably has a surface protection. For this purpose, the security system 100 may be provided with a protective film, a net, or a fabric to provide a protection against breaking open, cutting through, or drilling through.

In another preferred embodiment, the security system 100 may have an interface to read an RFID chip or a barcode in order to only then allow release (opening). Such an RFID chip or barcode may be situated at the target location (for example, at a bank). The security system 100 is only released after recognition of the RFID chip or the barcode.

A time window may preferably be predefined for the circuit of the (portable) module 10, the automatic neutralization being initiated after the time window has been exceeded.

The security circuit 12 is preferably designed in such a way that in case of emergency an LED begins to blink after a bouncing time. A prealarm then occurs, for example, acoustically, followed by a main alarm. The neutralization only occurs after this alarm phase. This sequence is preferably externally programmable (using a Pocket PC or computer).

Smoke is preferably discharged by the security modules in the security case upon the neutralization. This has a signal effect and thus prevents a perpetrator from carrying along the security case.

A further security precaution may comprise situating an airbag system on the container, for example. Such an airbag system must be conceived in such a way that it is activated or activatable in the event of unauthorized handling of the container. Unauthorized handling and transport of the container is made more difficult by the volume increase occurring upon actuation of the airbag system.

The invention claimed is:

1. A security system having a container which encloses a strongbox area for receiving valuables, means for carrying the container, an access opening, to be able to open the container and make the strongbox area accessible, wherein at least one protection module is provided in the strongbox area, the protection module being designed for the purpose of configured for neutralizing the valuables located in the strongbox area, the means for carrying being implemented as a separate module, which comprises a handle area, a mechanical interface for mechanical connection to the container, a security circuit for securing the security system, and a security interface for establishing a communication link between the security circuit and the protection module, including a contactless connection in which a transmitter interacts with a receiver configured for encrypted communication.

2. The security system according to claim 1, wherein the container has a receptacle area configured for docking of the separate module, including the mechanical connection and the establishment of the communication link occurring upon the docking.

3. The security system according to claim 2, wherein guide elements are provided in the receptacle area configured for inserting the separate module.

4. The security system according to claim 1 or 2, wherein at least one latch element is provided on at least one of the container and the separate module configured to mechanically latch the separate module onto the container.

5. The security system according to claim 1, wherein the security interface includes a plug-in connection, in which a first plug element on the separate module is pluggable into a second plug element on the container.

6. The security system according to claim 1, wherein the security interface includes an infrared interface and the communication link is configured for encrypted communication.

7. The security system according to claim 1, wherein at least one of the container and the separate module is at least partially made of thermoplastic material.

8. The security system according to claim 1, wherein the protection module is filled with a free-flowing material and discharges the material under pressure to neutralize the valuables.

9. The security system according to claim 1, wherein the security circuit is connectable via the security interface to the protection module and causes triggering of the protection module as soon as there is one of unauthorized manipulation of the security system and the security system is released from a hand.

10. The security system according to claim 1, comprising a further interface to allow settings of the security circuit using one of a Pocket PC and computer.

11. The security system according to claim 1, wherein the container is configured for receiving at least one currency cassette.

12. The security system according to claim 11, wherein the security circuit establishes the communication link via the security interface with the at least one currency cassettes after the at least one currency cassette has been placed into the strongbox area.

13. The security system according claim 1, wherein the container has a size and shape configured for the type of valuables to be transported.

14. The security system according to claim 1 or 2, wherein at least one latch element is provided on the container and on the separate module, configured to mechanically latch the separate module onto the container.

15. The security system according to claim 8, wherein the free-flowing material is selected from the group consisting of liquids and ink.

16. The security system according to claim 8, wherein the valuables are selected from the group consisting of securities and bank notes.

17. The security system according to claim 11, wherein the container is configured for receiving currency cassettes that are used in ATMs.

* * * * *